United States Patent [19]

Hamlin

[11] Patent Number: 4,838,456

[45] Date of Patent: Jun. 13, 1989

[54] ENCLOSED VAPOR DISPENSING APPARATUS AND METHOD

[76] Inventor: Jerry F. Hamlin, 874 Shirley La., Boulder City, Nev. 89005

[21] Appl. No.: 152,232

[22] Filed: Feb. 4, 1988

[51] Int. Cl.[4] ..... B67B 7/00; A61H 33/00

[52] U.S. Cl. ..... 222/1; 222/3; 222/131; 222/402.13; 222/402.15; 4/535; 220/87; 239/268; 141/363; 128/368; 422/299; 604/290

[58] Field of Search ..... 222/1, 3, 402.15, 402.13, 222/509, 647, 173, 180, 131, 164; 4/520, 535, 536, 222; 220/87; 604/289, 290; 128/1 R, 368; 239/578, 282, 283, 273, 268; 422/22, 28, 39, 292, 299; 141/363, 390

[56] References Cited

U.S. PATENT DOCUMENTS

| | | | |
|---|---|---|---|
| 2,866,472 | 12/1958 | Risely | 239/578 X |
| 2,967,643 | 1/1961 | Edelstein | 222/647 |
| 2,991,912 | 7/1961 | Thomas et al. | 222/647 |
| 3,018,056 | 1/1962 | Montgomery | 222/647 X |
| 3,101,716 | 8/1963 | Cornell, Jr. | 4/535 X |
| 3,127,065 | 3/1964 | Stevenson | 222/164 |
| 3,143,745 | 8/1964 | Price | 4/222 |
| 3,220,424 | 11/1965 | Nelson | 128/368 X |
| 3,683,896 | 8/1972 | Peplin | 604/289 X |
| 3,987,935 | 10/1976 | Caluscos | 222/509 X |
| 4,120,380 | 10/1978 | Mann | 222/509 X |
| 4,300,556 | 11/1981 | Ochi et al. | 128/368 X |
| 4,598,664 | 7/1986 | Hamlin | 118/325 |
| 4,670,010 | 6/1987 | Bragone | 604/289 |
| 4,670,916 | 6/1987 | Bloom | 4/222 X |

*Primary Examiner*—Kevin P. Shaver
*Assistant Examiner*—Gregory L. Huson
*Attorney, Agent, or Firm*—Victor Flores; Harry M. Weiss

[57] ABSTRACT

A dispensing apparatus and method for spraying the hands of a person is provided. The apparatus includes a housing having a plurality of walls forming a chamber for the hands and having an opening for inserting the hands into the chamber. The apparatus has an L-shaped actuating member having a pivot supported by a wall. The L-shaped member has a horizontal leg supported by the pivot, a disc portion disposed in the chamber for contact by the hands, and has a vertical leg with a tip bearing portion disposed outside the housing. The apparatus also has a resilient cantilever beam having a first portion with a cavity which receives a cap portion of an aerosol container, and having a second portion which is fixedly connected to a wall of the housing. The resilient cantilever beam has a passageway from the cavity to an orifice inside the chamber for spraying a substance. from the container, while containing the disc portion in the chamber. An upward force on the disc portion causes a downward force on the resilient cantilever beam to actuate the container. The resilient cantilever beam springs back to its release position when the force is removed and the flow of the substance is stopped.

9 Claims, 2 Drawing Sheets

ENCLOSED VAPOR DISPENSING APPARATUS AND METHOD

BACKGROUND OF THE INVENTION

1. Field of the Invention

The invention generally relates to a fluid dispensing apparatus and method, and, in particular, the invention relates to an aerosol type spray dispensing apparatus and method comprising a housing with an open-sided chamber and having a cantilever beam or lever with passage means and having actuating means operable by hand within ther chamber to actuate an aerosol type container located outside the chamber to dispense a spray into the chamber either onto the hands of the person actuating the beam or lever or onto an object held by the person actuating the beam or lever.

2. Description of the Relative Art

A prior art dispensing apparatus is shown and described in U.S. Pat. No. 4,598,664, issued July 8, 1986 in the name of Jerry F. Hamlin who is also the inventor of this application.

The prior art dispensing apparatus includes a housing having a fully closed chamber for storing paper to be impregnated with a substance, and includes a cantilever beam mounted outside the housing and having passage means for passage of the substance from an outside aerosol container to the chamber.

One problem with the prior art dispensing apparatus is that it is not suitable for use in spraying the hands of a person.

SUMMARY OF THE INVENTION

According to the present invention, a dispensing apparatus is provided. The apparatus comprises a housing having an opensided chamber for use in enclosing the hands of a person, and comprises a cantilever beam mounted outside the housing and having passage means for the passage of a substance from an outside aerosol container to the chamber, and comprises actuating means operable by hand inside the chamber for permitting simultaneous spraying of the hands and actuating the aerosol container to dispense its contained substance through the passage and into the chamber.

The foregoing and other objects, features and advantages will be apparent from the following description of the preferred embodiment of the invention as illustrated in the accompanying drawings.

DESCRIPTION OF THE PREFERRED EMBODIMENTS

Figure 1:
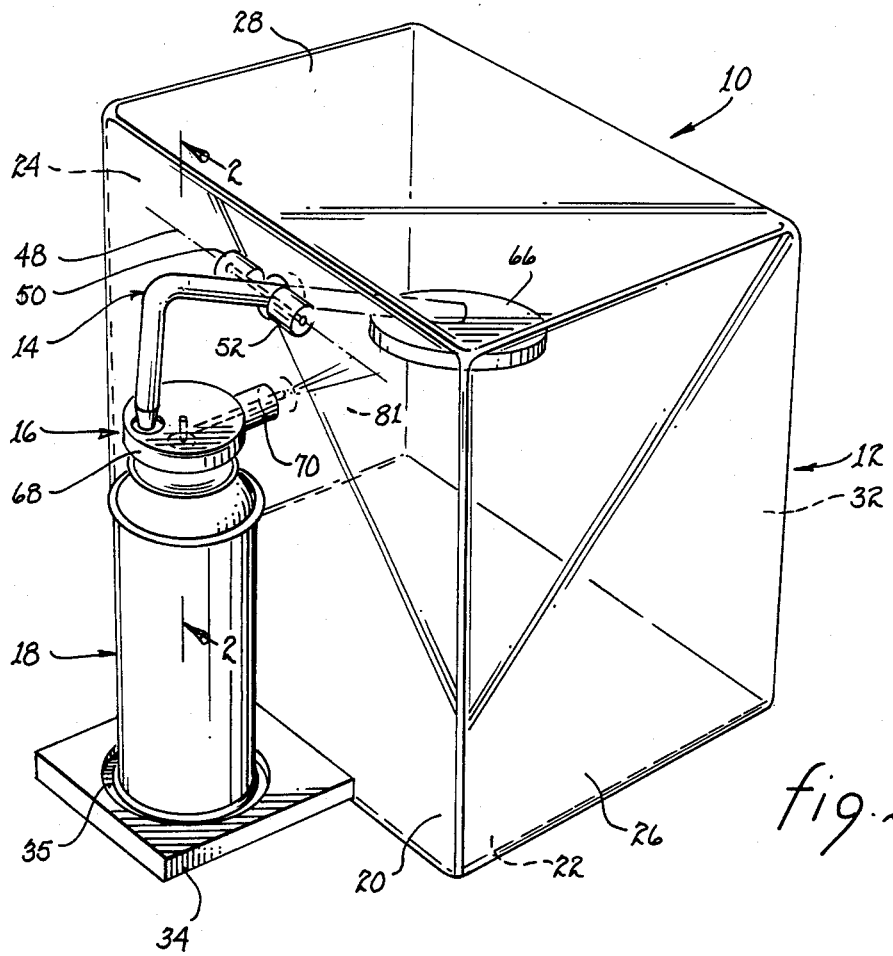
FIG. 1 is a perspective view of an embodiment of the invention.
Figure 2:
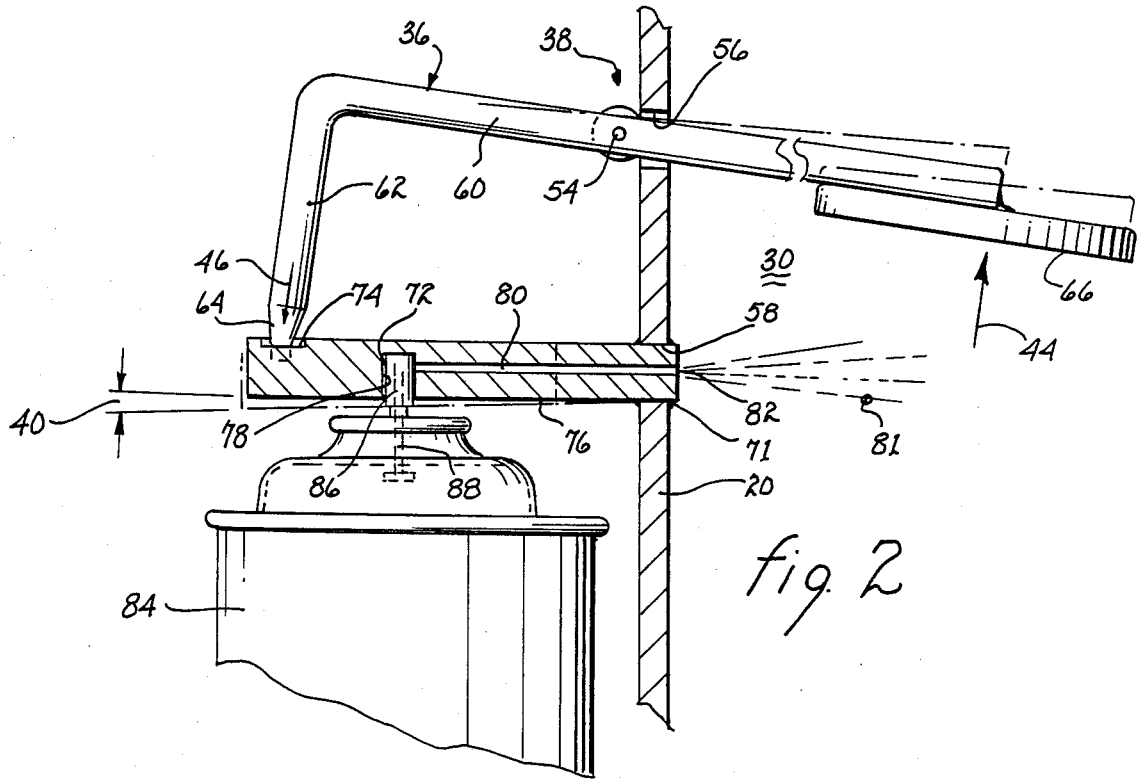
FIG. 2 is a section view taken along the line 2—2 of FIG. 1.

In FIG. 1 and 2, a dispensing apparatus 10 according to the invention is shown. Apparatus 10 includes a housing 12, acuating means 14, which is supported by the housing 12, a resilient cantilever beam 16 which is also supported by housing 12, and an aerosol container 18 which is disposed outside of housing 12. While the hands of a person are enclosed within housing 12, the actuating means 14 can be engaged by a hand to cause a substance to be released by aerosol container 18 and to be conducted through the resilient cantilever beam 16 to the hands within housing 12.

Housing 12 includes a front wall 20, a bottom wall 22, a left side wall 24, a right side wall 26, and a top wall 28, which together form a chamber 30. Housing 12 has a rear opening 32 to chamber 30 through which the hands of a person can be inserted into chamber 30. Bottom wall 22 is fixedly connected to a platform portion 34, which has a recess 35 for receiving aerosol container 18. Housing 12 is preferably made of transparent plexi-glass or plastic type material in this embodiment.

In FIGS. 1 and 2, actuating means 14 includes an L-shaped member 36, and a pivot means 38, which pivotally supports L-shaped member 36. By applying an upward force 44 by a person's hand to L-shaped member 36 within chamber 30, a downward force 46 acts on resilient cantilever beam 16 which causes resilient cantilever beam 16 to deflect downwardly through an angle of deflection 40, thereby actuating container 18.

Pivot means 38, which has a pivot axis 48, includes a left collar 50 which is fixedly connected to front wall 20, a right collar 52 which is fixedly connected to front wall 20, and a pivot pin 54 which is journaled in collars 50 and 52. Pivot pin 54 extends through and is connected by a loose fit to L-shaped member 36.

L-shaped member 36 passes through an opening 56 in front wall 20. Another opening 58 in front wall 20 receives cantilever beam 16, as explained hereafter, in order to form a fixed connection of beam 16 to front wall 20.

In FIG. 1 and 2, L-shaped member 36 has a horizontal leg 60 and a vertical leg 62, which has a top bearing portion 64. Horizontal leg 60 is fixedly connected to a disc member 66 for hand operation of L-shaped member 36. A part of a hand remains in contact with disc 66 in order to actuate the aerosol container 18 to release a substance through beam 16 to the hands.

Resilient cantilever beam 16 includes an outer portion of circular profile 68 and an inner tubular portion 70. Tubular portion 70 is press fit within opening 58. An adhesive deposit or fillet weld 71 of annular shape joins tubular portion 70 to front wall 20. Beam 16 has an upper face 72, which has a bearing recess 74 that receives tip portion 64. Beam 16 also has a lower face 76. Beam 16 has a cavity 78 in face 76 and a passageway 80, which extends from cavity 78 to an orifice 82. When aerosol container 18 is actuated by force 46, which passes through top portion 64 and beam 16, a substance passes through passageway 80 and emits from 82 as a spray 81.

Aerosol container 18 has a lower can portion 84 which is recieved in recess 35, and an upper, spring-biased cap portion 86, which is received in cavity 78. A passageway 88 extends through cap portion 86 for emitting a substance into passageway 80 when cap portion 86 is pressed down by beam 16 and top portion 64.

Resilient cantilever beam 16 springs back, upwardly through angle 40, to its release position, when force 44 is not applied any longer. Thus, the flow of the substance is stopped.

For ease of maintenance, aerosol container 18 can be removed by lifting beam 16 and moving container 18 out of recess 35 and cavity 78. A replacement container containing any desired substance can then be rapidly and easily installed in a removal procedure.

Figure 3:
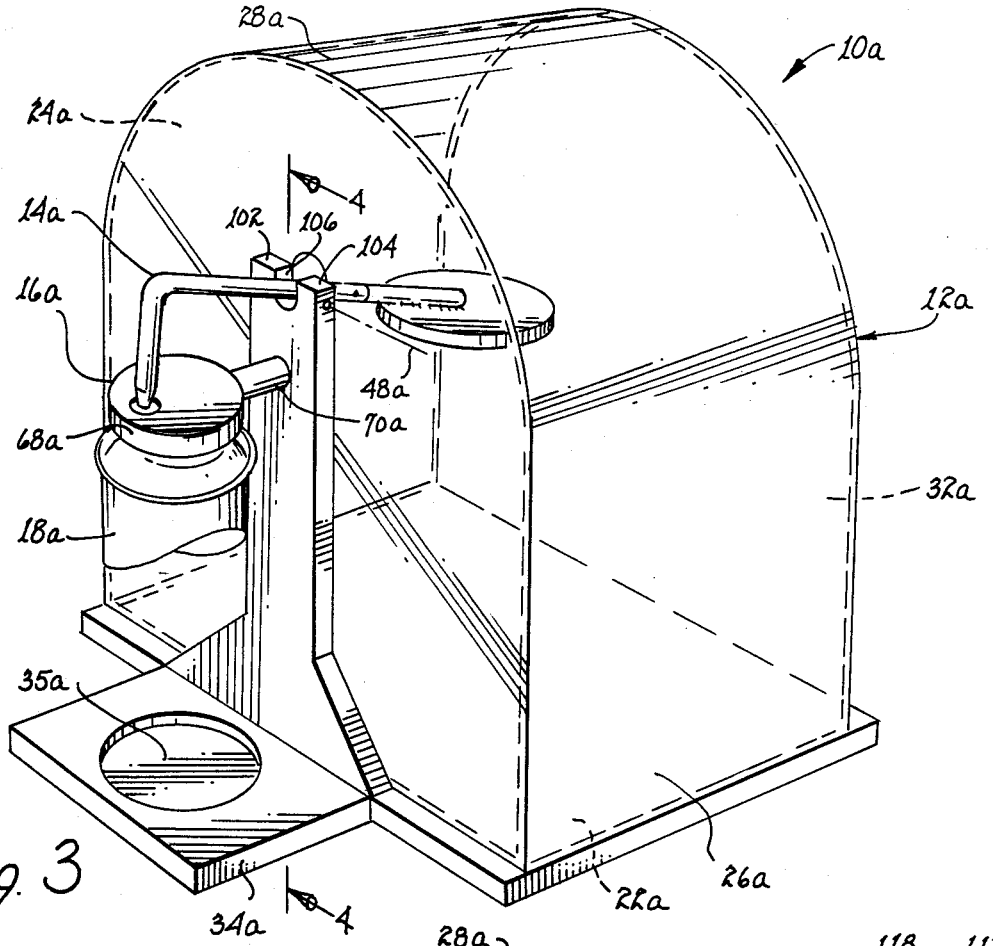
FIG. 3 is a perspective view of another embodiment of the invention.
Figure 4:
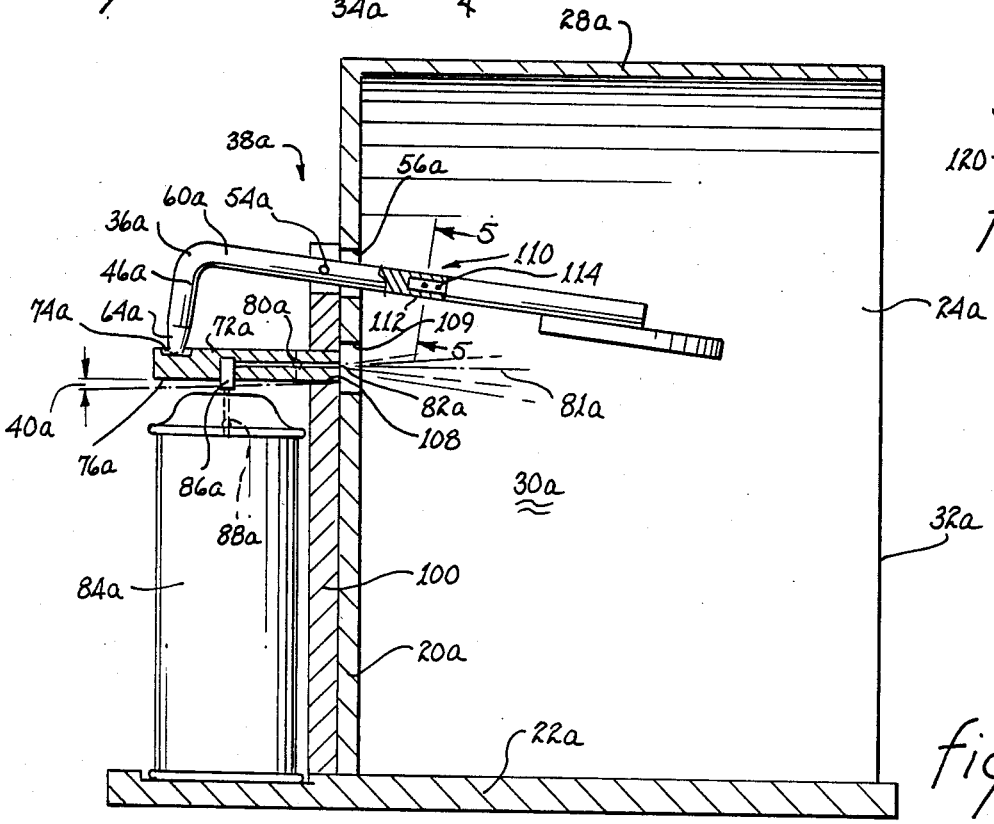
FIG. 4 is a section view taken along the line 4—4 of FIG. 3.

In FIGS. 3 and 4, an alternate embodiment of dispensing apparatus 10*a* is shown. Each part of FIGS. 3 and 4, which is the same as a corresponding part of FIGS. 1 and 2 has the same numeral, but with a subscript "a" added thereto.

Dispensing apparatus 10*a* includes a housing 12*a*, means 14*a*, a resilient cantilever beam 16*a*, and an aerosol container 18*a*.

Housing 12*a* includes a front wall 20*a*, a bottom wall 22*a*, a left side wall 24*a*, a right side wall 26*a*, and a top wall 28*a*, which together forms a chamber 30*a*. Housing 12*a* has a rear opening 32*a*. Bottom wall 22*a* is fixedly connected to a platform portion 34*a*, which has a recess 35*a*. A support wall 100 rests on platform portion 34*a* and is connected to front wall 20*a*.

In FIGS. 3 and 4, actuating means 14*a* includes an L-shaped member 36*a*, and a pivot means 38*a*. By supplying an upward force 44*a* by a hand to L-shaped member 36*a* within chamber 30*a*, a downward force 46*a* acts on resilient cantilever beam 16*a*, which causes resilient cantilever beam 16*a* to deflect downwardly through an angle of deflection 40*a*, thereby actuating container 18*a*.

Pivot means 38*a*, which has a pivot axis 48*a* includes a pivot pin 54*a* which is connected by a loose fit to L-shaped member 36*a*.

Support 100 has extensions 102 and 104, which are seperated by a notch 106. Pivot pin 54*a* is journaled in respective holes in extension 102, 104. L-shaped member 36*a* passes through an opening 56*a* in front wall 20*a*. Support 100 has a hole 108 in which beam 16*a* is press fit to form a fixed connection between support 100 and beam 16*a*.

In FIGS. 3 and 4, L-shaped member 36*a* has a horizontal leg 60*a* and a vertical leg 62*a*. Horizontal leg 60*a* has a disc member 66*a*, which is fixedly connected thereto. Vertical leg 62*a* has a tip bearing portion 64*a*.

Figure 5:
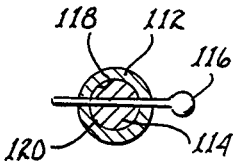
FIG. 5 is a section view taken along the line 5—5 of FIG. 4.

As shown in FIGS. 4 and 5, horizontal leg 60*a* has an assembly joint 110 for separating a left portion 112 from a right portion 114. Left portion 112 has a drilled hole with a circular inner surface 118. Right portion 114 has an extension with a circular outer surface 120. There is a very small gap between surfaces 118 and 120. Leg 60*a* has a cotter pin 116 which passes through portions 112, 114, thereby forming assembly joint 110. It is easier to manufacture embodiment 10*a* of FIG. 3, as compared to embodiment 10 of FIG. 1, because of the rounded configuration of the external housing making it much simpler and less expensive to fabricate using a mold process than the rectangular housing of FIG. 1.

Also, if desired, left portion 112 can be inserted from the left side of wall 20*a* through opening 56*a*, and right portion 114 can be inserted through opening 32*a* into chamber 30*a*, and the assembly of portions 112 and 114 can be made within chamber 30*a*. It is also easier to repair and replace part 36*a* by disassembly of joint 110.

Beam 16*a* has an outer circular portion 68*a* and an inner tubular portion 70*a*, which is press fit into hole 108 in support wall 100 and which is joined thereto by an adhesive deposit or fillet weld (not shown). A hole 109 in wall 20*a* is coaxial with hole 108 in wall 100.

Beam 16*a* has an upper face 72*a*, which has a bearing recess 74*a* that receives top portions 64*a*. Beam 16*a* also has a lower face 76*a* which has a cavity 78*a*, and has a passageway 80*a* which extends from cavity 78*a* to an orifice 82*a* inside chamber 30*a*. The substance from container 18*a*, when actuated, passes through passageway 80*a* and leaves orifice 82*a* as a spray 81*a*.

Container 18*a* has a lower can portion 84*a* which is received in recess 35*a*, and an upper, spring-biased cap portion 86*a* which is received in cavity 78*a*. Another passageway 88*a* extends through cap portion 86*a* and connects to passageway 80*a*.

In use, an upward force 44*a*, applied by hand, pivots L-shaped member 36*a* causing a downward force 46*a*, deflecting beam 16*a* through angle 40*a*, and acting on top portion 86*a*, thereby causing a substance from container 18*a* to pass through passageway 88*a*, through passageway 80*a*, and out through orifice 82*a*, as a spray 81*a* either on the hands or onto an object held by the hands.

While the invention has bee described in its perferred embodiments, it is to be understood that the words which have been used are words of description rather than limitation and that changes may be made within the purview of the appended claims without departing from the true scope and spirit of the invention in its broader aspects.

For example, housing 12 can be made of a transparent plastic material or a light weight (i.e. aluminum) metal material.

As another example, container 18 can be a pump-type container, instead of an aerosol container.

As another example, paper, such as paper tissues or the like, can be held by hand so that a substance can be sprayed into chamber 30 for impregnating the paper. Various substances can be selected to be sprayed onto a person's hand(s) or an object like a tissue held by hand such as a cleansing substance, a perfume (i.e. aroma producing) type substance, a medicated type substance, etc.

As still another example, opening 32*a* can have a fold-down door and a latch.

I claim:

1. A dispensing apparatus comprising:

a housing having a chamber, said housing having a plurality of walls enclosing the chamber, and an opening for insertion of the hands into the chamber;

mechanically actuating means in the form of a pivotable lever having a portion disposed in the chamber and a portion outside of the housing to actuate a pressurized aerosol container and a member having passage means for conducting the pressurized substance from the aerosol container to the chamber upon applying a force to the portion of the actuating lever disposed in the chamber, the member having passage means and being a resilient cantilever beam having a first portion with a recess for receiving a cap portion defining an outlet valve from said aerosol container and having a second portion fixedly connected to a wall, and the passage means having a passageway from the recess extending through the first portion and the second portion to an orifice disposed within the chamber for spraying therein.

2. The apparatus of claim 1, including pivot means for supporting the pivotable member, the pivotable member being an L-shaped member having a horizontal leg with a hand operable disc portion disposed in the chamber and having a vertical leg with a tip bearing portion disposed outside of the housing for applying a force to the cap portion of the aerosol container, said pivot means having a pivot pin with a pivot axis for supporting the L-shaped member, and having a pair of spaced pivot supports coaxial with the pivot pin along the pivot axis for support by a wall and for supporting the pivot pin.

3. The apparatus of claim 2, wherein the resilient cantilever beam has an upper face with a bearing recess that receives the tip bearing portion of the L-shaped member for applying a force from the tip bearing portion through the beam to the aerosol container cap portion.

4. A method for dispensing a substance comprising the steps of:

providing a housing having a chamber;

adapting the housing with a plurality of walls enclosing the chamber, and with an opening for inserting of the hands into the chamber;

providing a mechanically actuating means in the form of a pivotable lever having a portion disposed in the chamber and a portion outside the housing to actuate a pressurized aerosol container;

providing a member having passage means for conducting a pressurized substance from the aerosol container to the chamber;

adapting the member having passage means as a resilient cantilever beam having a first portion with a recess for receiving a cap portion defining an outlet valve of the aerosol container and having a second portion fixedly connected to a wall, and having the passage means as ٦ passage way from the recess extending through the first portion and the second portion to an orifice disposed within the chamber for spraying therein; and applying a force to the portion of the actuating lever disposed in the chamber to cause the substance within said container to be dispensed into the chamber beneath said actuating means.

5. The method of claim 4, including pivot means for supporting the pivotable lever, the pivotable lever being an L-shaped member having a horizontal leg with a hand operable disc portion disposed in the chamber and having a vertical leg with a tip bearing portion disposed outside of the housing for applying a force to the cap portion of the aerosol container, the pivot means having a pivot pin with a pivot axis for supporting the L-shaped member, and having a pair of spaced pivot supports coaxial with the pivot pin along the pivot axis for support by a wall and for supporting the pivot pin.

6. The method of claim 5 wherein the resilient cantilever beam has an upper face with a bearing recess that recieves the tip bearing portion of the L-shaped member for applying a force from the tip bearing portion through the beam to the aerosol container cap portion.

7. A dispensing apparatus comprising:

a housing having a chamber, said housing having a plurality of walls enclosing the chamber, and an opening for inserting the hands of a user into said chamber;

mechanically actuating means having a portion disposed in said chamber and a portion outside the housing to actuate a pressurized aerosol container, said mechanically actuating means having a pivotable lever, and pivot means for supporting the pivotable lever; and a member having passage means for conducting a substance from a container to the chamber upon applying a force to the portion of the actuating means disposed in the chamber, said member having passage means is a resilient cantilever beam having a first portion with a recess for receiving a cap portion defining an outlet value of the aerosol container and having a second portion fixedly connected to a wall, and the passage means includes a passageway from the recess extending through the first portion and the second portion to an orifice disposed within the chamber for spraying therein.

8. The apparatus of claim 7, wherein the pivotable lever is an L-shaped member having a horizontal leg with a hand operable disc portion disposed in the chamber and having a vertical leg with a tip bearing portion disposed outside of the housing for applying a force to the cap of the aerosol container, said pivot means having a pivot pin with a pivot axis for supporting the L-shaped member, and having a pair of spaced pivot supports coaxial with the pivot pin along the pivot axis for support by a wall and for supporting the pivot pin.

9. The apparatus of claim 8, wherein said resilient cantilever beam has an upper face with a bearing recess that receives the tip bearing portion of the L-shaped member for applying a force from the tip bearing portion through the beam to the cap of the container.

* * * * *